US005971807A

United States Patent [19]

Lin

[11] Patent Number: 5,971,807

[45] Date of Patent: Oct. 26, 1999

[54] LAMP RECEPTACLE ASSEMBLY

[76] Inventor: Mei-Lu Lin, 56, Min Sheng Street, Fengyuan, Taichung Hsien, Taiwan, 420

[21] Appl. No.: 08/979,708

[22] Filed: Nov. 27, 1997

[51] Int. Cl.[6] ..... H01R 13/68

[52] U.S. Cl. ..... 439/646; 439/622

[58] Field of Search ..... 439/646, 645, 439/622, 505, 519

[56] References Cited

U.S. PATENT DOCUMENTS

| | | | |
|---|---|---|---|
| 1,123,002 | 12/1914 | Platt | 439/646 |
| 1,504,655 | 8/1924 | Thompson | 439/646 |
| 5,451,173 | 9/1995 | Mai | 439/622 |
| 5,637,017 | 6/1997 | Hsu | 439/622 |

*Primary Examiner*—Edgar Burr
*Assistant Examiner*—Leslie Grohusky

[57] ABSTRACT

A lamp receptacle assembly has a hollow main body, a screw base disposed on a bottom of the main body, and a positioning plate inserted in the main body. The main body has two parallel slide rails, a through hole, an outer annular body, an inner annular body, a spacing, and a plurality of protruded plates. The positioning plate has a first channel, a second channel, a periphery slot, a rectangular groove, a first slot, and a second slot. A first conductive plate has a curved end and a first L-shaped end. A second conductive plate has a U-shaped end and a second L-shaped end. A U-shaped conductive plate has a curved terminal. The first conductive plate is inserted in the first channel. The second conductive plate is inserted in the second channel. The second L-shaped end is inserted in the periphery slot. The U-shaped end, the U-shaped conductive plate, and a fuse tube are inserted in the rectangular groove.

1 Claim, 6 Drawing Sheets

LAMP RECEPTACLE ASSEMBLY

BACKGROUND OF THE INVENTION

This invention relates to a lamp receptacle assembly, and more particularly, this invention relates to a lamp receptacle assembly which is disposed on a lamp string.

A conventional lamp string for a Christmas tree has a plug. An additional lamp string needs an additional plug. However, two lamp strings cannot be combined together because the additional plug cannot be disposed on the original lamp string in parallel. Since a receptacle cannot be disposed on the original lamp string in parallel, the additional plug cannot be disposed on the original lamp string. Referring to FIG. 1, a conventional lamp string has two wires 2 connected to a plurality of lamps in parallel. A plug 1 is connected to the ends of the wires 2. Each lamp has a socket 3 and a bulb 4 disposed on the socket 3. Since a receptacle cannot be disposed on the original lamp string in parallel, two lamp strings cannot be combined in parallel.

SUMMARY OF THE INVENTION

An object of this invention is to provide a lamp plug assembly which is disposed on a lamp string in parallel in order to receive a plug of another lamp string.

DETAILED DESCRIPTION OF THE INVENTION

Figure 1:
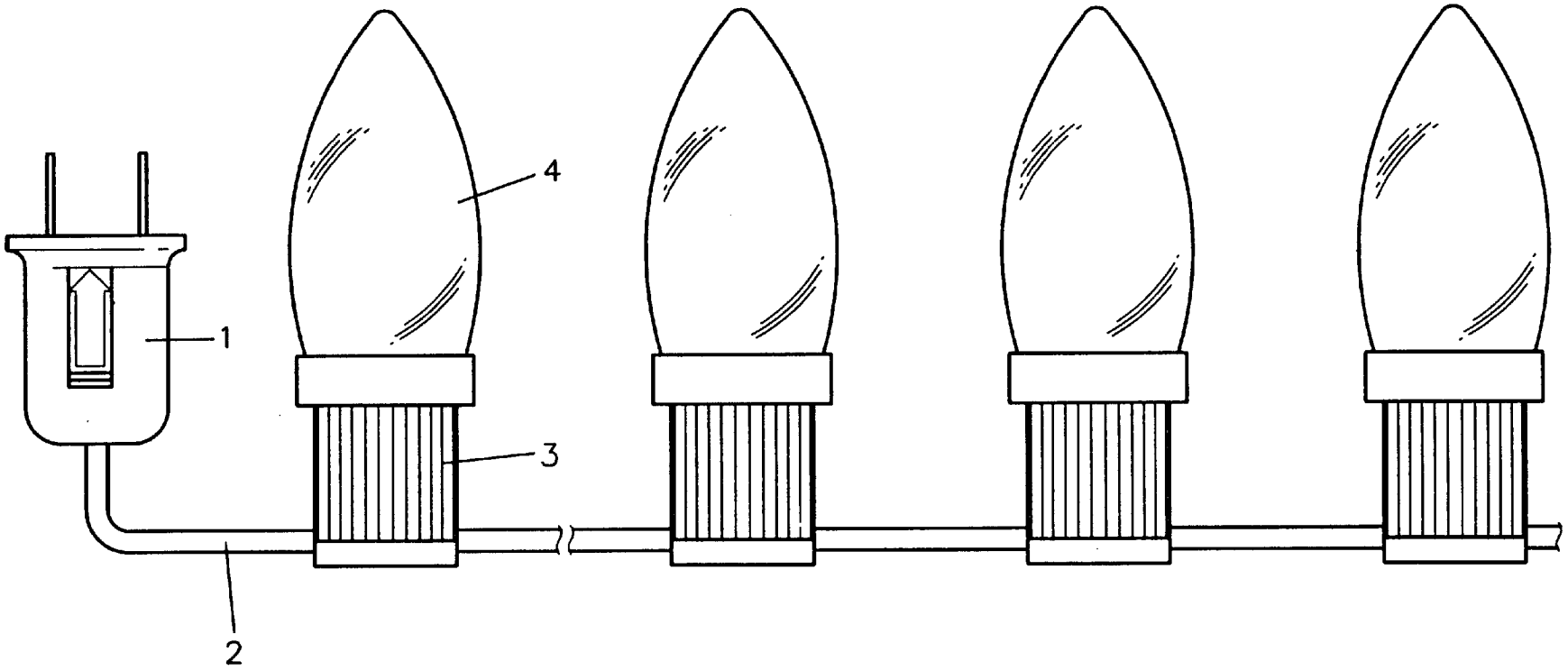
FIG. 1 Prior Art
FIG. 1 is an elevational schematic view illustrating a conventional lamp string of the prior art.
Figure 2:
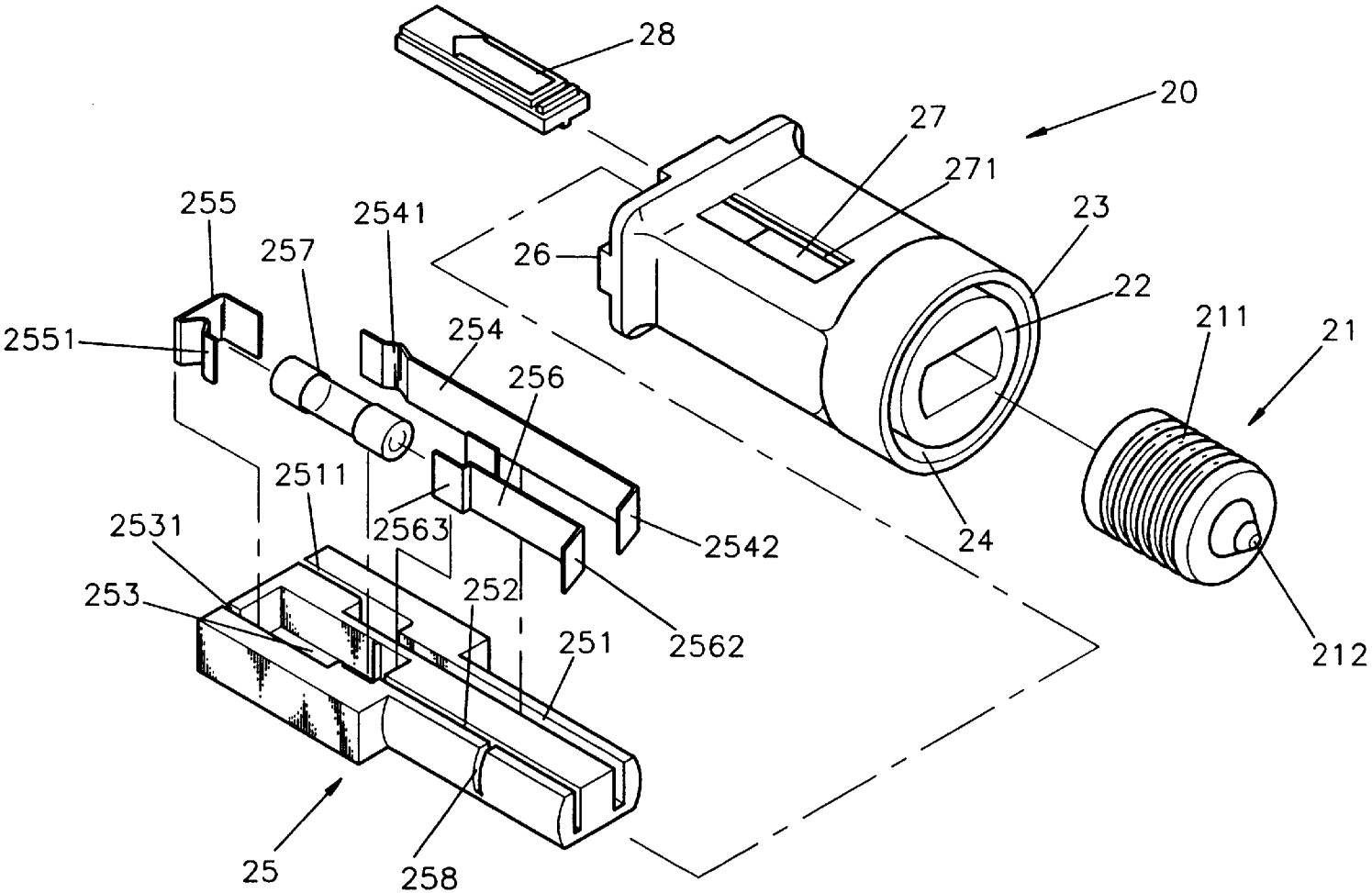
FIG. 2 is a perspective exploded view of a lamp receptacle assembly of a preferred embodiment.
Figure 3:
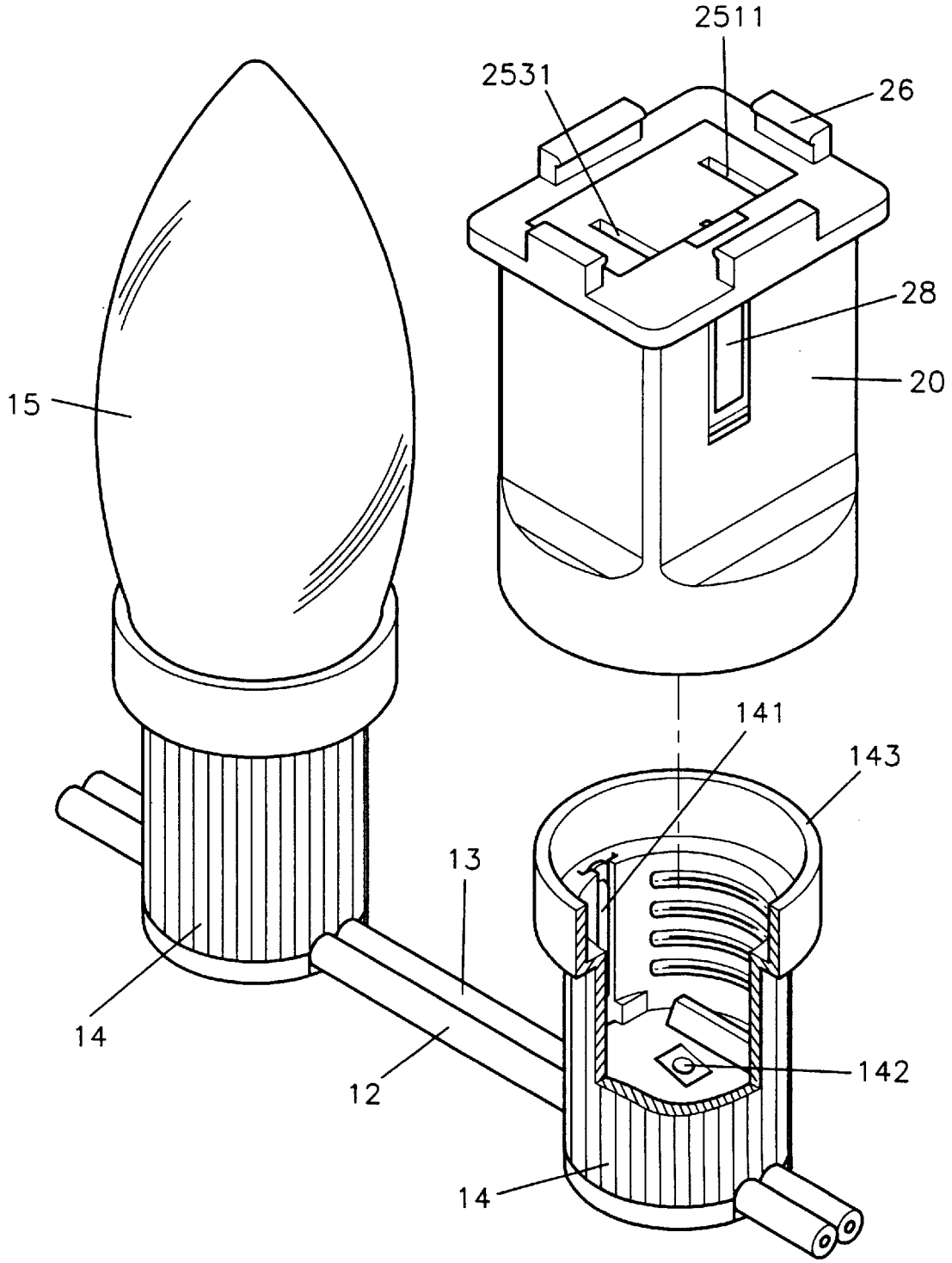
FIG. 3 is a schematic view illustrating a lamp receptacle assembly of a preferred embodiment coupled with a socket of a lamp string.
Figure 4:
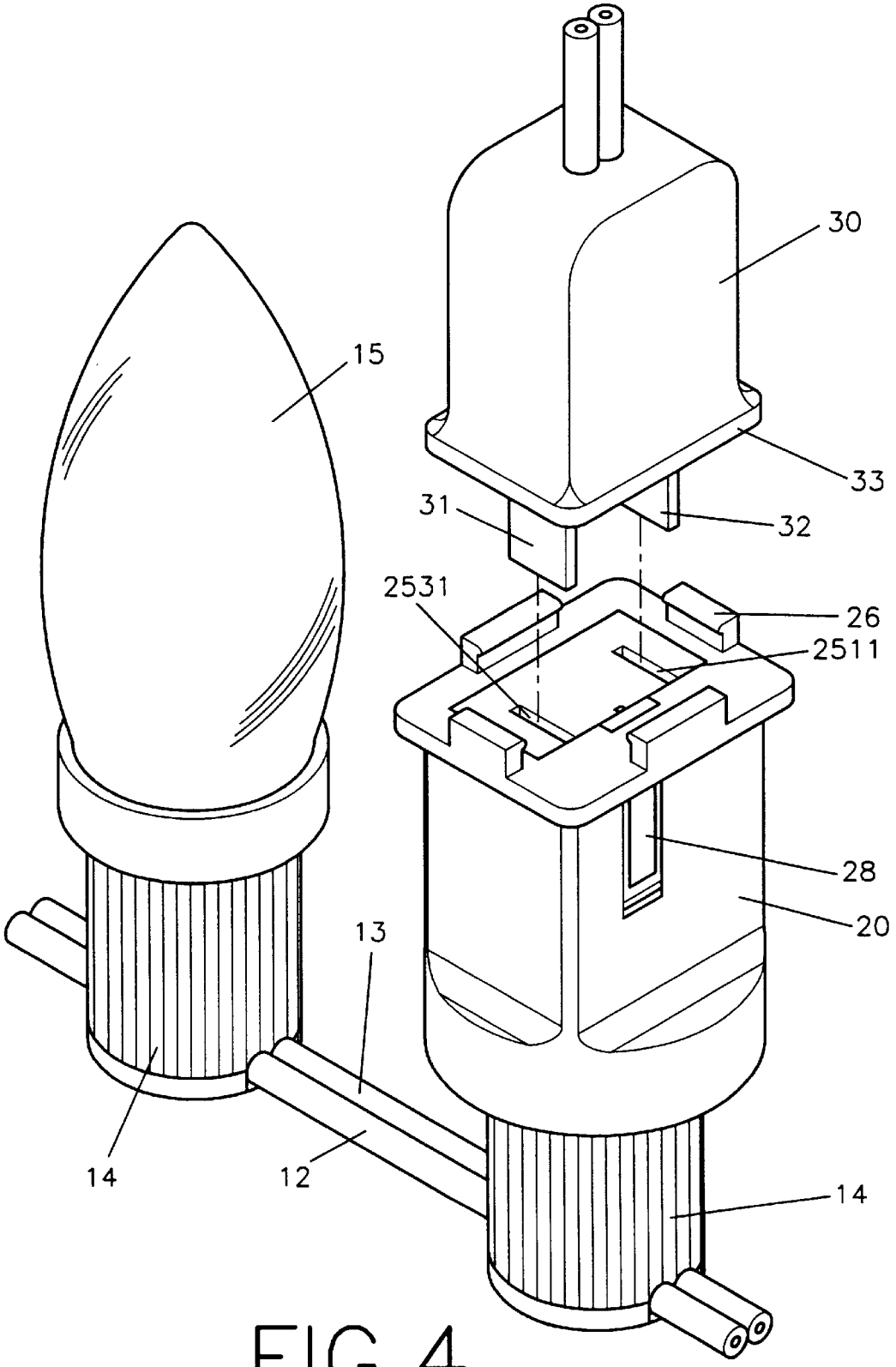
FIG. 4 is a schematic view illustrating a plug of another lamp string inserted in a lamp receptacle assembly of a preferred embodiment.
Figure 5:
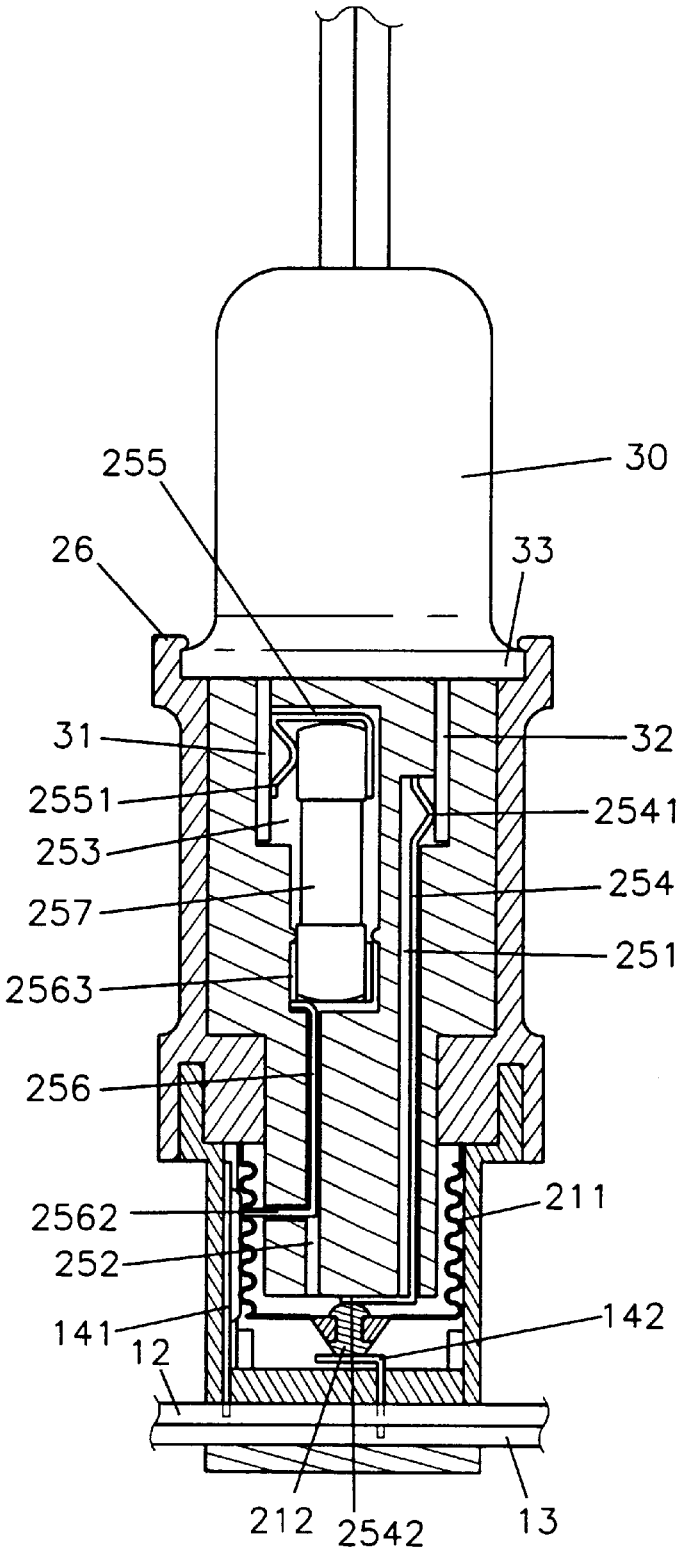
FIG. 5 is a sectional view of a lamp receptacle assembly of a preferred embodiment while a plug of another lamp string engaging with the lamp receptacle assembly.
Figure 6:
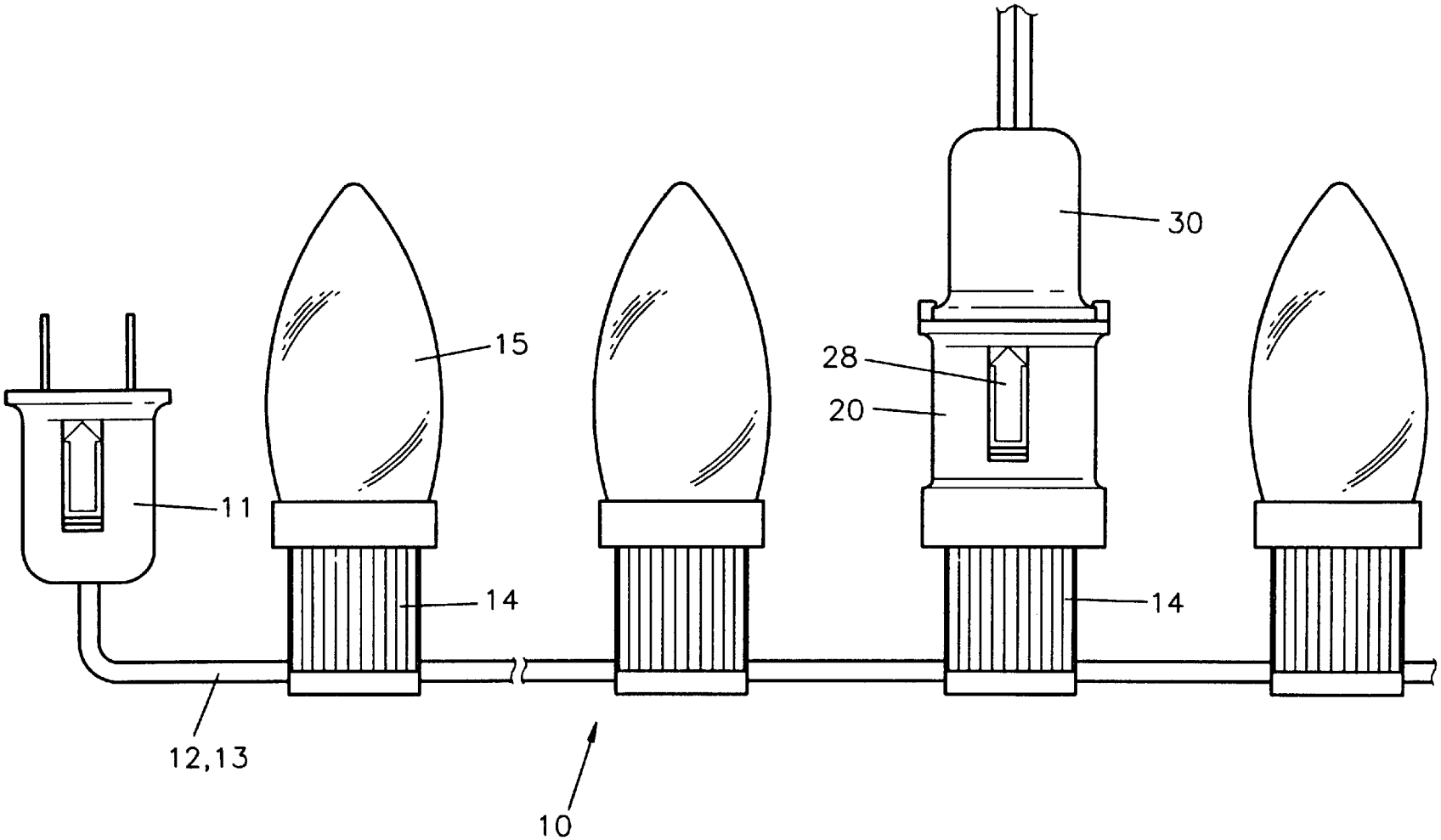
FIG. 6 is an elevational schematic view illustrating an application of a lamp receptacle assembly of a preferred embodiment.

Referring to FIGS. 2 to 6, a parallel-type lamp string 10 has a first and a second wires 12 and 13 connected to a plurality of lamps in parallel. A plug 11 is connected to the ends of the wires 12 and 13. Each lamp has a socket 14 and a bulb 15 disposed on the socket 14. The structure of the socket 14 is the same as the structure of a conventional socket. The socket 14 has a first copper plate 141 disposed on an inner periphery of the socket 14 and a second copper plate 142 disposed in an inner bottom of the socket 14. An end of the first copper plate 141 inserted in the first wire 12. An end of the second copper plate 142 inserted in the second wire 13. A lamp receptacle assembly couples with the socket 14. A plug 30 of another lamp string engages with the lamp receptacle assembly 20.

The lamp receptacle assembly has a hollow main body 20, a screw base 21 disposed on a bottom of the main body 20, and a positioning plate 25 inserted in the main body 20. The screw base 21 has a protruded end 212 and a threaded portion 211. The main body 20 has two parallel slide rails 271 defining a through hole 27, an outer annular body 23 disposed on a lower end of the main body 20, an inner annular body 22 surrounded by the outer annular body 23, a spacing 24 defined between the inner annular body 22 and the outer annular body 23, and a plurality of protruded plates 26 disposed on a top portion 20 of the main body 20. A slide plate 28 is inserted in the through hole 27 via the parallel slide rails 271.

The positioning plate 25 has a first channel 251, a second channel 252 parallel to the first channel 251, a periphery slot 258 communicating with the second channel 25 252, a rectangular groove 253 communicating with the second channel 252, a first slot 2511 communicating with the first channel 251, and a second slot 2531 communicating with the rectangular groove 253.

A first conductive plate 254 has a curved end 2541 and a first L-shaped end 2542. A second conductive plate 256 has a U-shaped end 2563 and a second L-shaped end 2562. A U-shaped conductive plate 255 has a curved terminal 2551. The first conductive plate 254 is inserted in the first channel 251. The second conductive plate 256 is inserted in the second channel 252. The second L-shaped end 2562 is inserted in the periphery slot 258. The U-shaped end 2563 is inserted in the rectangular groove 253. The U-shaped conductive plate 255 is inserted in the rectangular groove 253. A fuse tube 257 is inserted in the rectangular groove 253 and confined between the U-shaped end 2563 and the U-shaped conductive plate 255.

The first L-shaped end 2542 and the second L-shaped end 2562 contact the screw base 21. The protruded end 212 contacts the second copper plate 142. The threaded portion 211 contacts the first copper plate 141.

The socket 14 has an upper annular flange 143 inserted in the spacing 24. The through hole 27 matches the rectangular groove 253.

The plug 30 has a terminal flange 33 blocked by the protruded plates 26, a first blade 31 inserted in the second slot 2531, and a second blade 32 inserted in the first slot 2511. The curved terminal 2551 contacts the first blade 31. The curved end 2541 contacts the second blade 32.

This invention has the following advantages.

Any bulb 15 can be replaced by the lamp receptacle assembly.

The lamp receptacle assembly can be screwed into a socket easily.

Therefore, two or more lamp strings can be combined together via the plugs and the lamp receptacle assemblies.

I claim:

1. A lamp receptacle assembly comprises:

a hollow main body, a screw base disposed on a bottom of the main body, a positioning plate inserted in the main body, the screw base having a protruded end and a threaded portion, the main body having two parallel slide rails defining a through hole, an outer annular body disposed on a lower end of the main body, an inner annular body surrounded by the outer annular body, a spacing defined between the inner annular body and the outer annular body, and a plurality of protruded plates disposed on a top portion of the main body, a slide plate inserted in the through hole via the parallel slide rails, the positioning plate having a first channel, a second channel parallel to the first channel, a periphery slot communicating with the second channel, a rectangular groove communicating with the second channel, a first slot communicating with the first channel, and a second slot communicating with the rectangular groove, a first conductive plate having a curved end and a first L-shaped end, a second conductive plate having a U-shaped end and a second L-shaped end, a U-shaped conductive plate having a curved terminal, the first conductive plate inserted in the first channel, the second conductive plate inserted in the second channel, the second L-shaped end inserted in the periphery slot, the U-shaped end inserted in the rectangular groove, the U-shaped conductive plate inserted in the rectangular groove, and a fuse tube inserted in the rectangular groove and confined between the U-shaped end and the U-shaped conductive plate.

* * * * *